US006032999A

United States Patent [19]

York et al.

[11] Patent Number: 6,032,999

[45] Date of Patent: Mar. 7, 2000

[54] GOLF CLUB AND ACCESSORY CARRIER

[75] Inventors: Michael T. York, Chelsea; Richard K. Harris, Walled Lake; Steve Yockey, Ann Arbor, all of Mich.

[73] Assignee: Progressive Concepts, Inc., Walled Lake, Mich.

[21] Appl. No.: 09/062,951

[22] Filed: Apr. 20, 1998

[51] Int. Cl.[7] ..... A63B 55/10

[52] U.S. Cl. ..... 294/143; 211/70.2; 294/146; 294/161

[58] Field of Search ..... 294/142, 143, 294/146, 159, 161, 165, 166; 43/21.2; 206/315.2, 315.11, 443; 211/60.1, 68, 7.05, 70.2, 70.8; 224/922

[56] References Cited

U.S. PATENT DOCUMENTS

| | | | |
|---|---|---|---|
| 2,024,484 | 12/1935 | Smith . | |
| 2,415,314 | 2/1947 | Todd | 294/146 X |
| 2,737,990 | 3/1956 | De Marco | 294/146 X |
| 2,791,255 | 5/1957 | Ogden | 294/143 |
| 2,990,865 | 7/1961 | Steele . | |
| 3,215,181 | 11/1965 | Reed . | |
| 3,415,572 | 12/1968 | Zagwyn | 294/143 X |
| 3,483,996 | 12/1969 | Scammon | 294/143 |
| 4,036,416 | 7/1977 | Lowe . | |
| 4,154,274 | 5/1979 | Adamson . | |
| 4,616,749 | 10/1986 | Briggs . | |
| 4,666,038 | 5/1987 | Minneman . | |
| 4,779,914 | 10/1988 | Friedline | 294/143 |
| 5,209,539 | 5/1993 | Atalay | 294/143 |
| 5,314,079 | 5/1994 | Young | 211/70.2 |
| 5,492,384 | 2/1996 | Tarko et al. | 294/143 |

*Primary Examiner*—Johnny D. Cherry

[57] ABSTRACT

A lightweight golf club and accessory carrier for transporting and retaining a plurality of golf clubs, tees, balls marker and score keeping pencil in a compact package size. The carrier is made out of a flexible plastic material in the form of a single injection molded body comprising a handle connected to the inside surfaces near the top of two downwardly extending end walls. Near the bottom of the device, a ball carrier extends between the inside surface of each end wall. The ball carrier is design to hold three golf balls within a flexible plastic structure that enables the balls to be installed or removed from either the from or back of the carrier. A plurality of flexible club holding clips extend off of the outside and inside surfaces of each end wall and are configured to retain the shaft of a typical golf club. In addition, a plurality of tee mounts, a ball marker mount and a pencil mount the outside surfaces of the end walls and are configured to hold golf tees, a ball marker score keeping pencil respectively.

20 Claims, 3 Drawing Sheets

GOLF CLUB AND ACCESSORY CARRIER

BACKGROUND

1. Field of Invention

This invention relates to carrying devices and, in particular, to a golf club and accessory carrier and holder which retains a plurality of golf clubs, balls and tees, a ball marker, and a score keeping pencil.

2. Description of Prior Art

A wide variety of means are utilized to retain and transport golf clubs and accessories during a round of golf. The devices range from mechanized golf carts and cumbersome golf bags to devices for carrying a few clubs. Although in tournament play as well as recreational matches it may be necessary to have a full set of golf clubs plus accessories and therefore a golf bag and cart, many times it is not necessary to carry a full set and less than eight clubs with a few accessories will suffice. In addition to greatly reducing the weight which must be carried during play, the expense of a full set of clubs and a bag may be prohibitive to the beginning golfer. In fact, youth golf club sets are typically configured with less than six clubs. Thus, it can be advantageous for the beginning golfer or when a quick practice round is desired for the veteran golfer, to carry and retain only a minimum number of clubs and accessories during the round. Generally, all that is required may be a driver, a putter, two irons, and a couple of balls and tees. In addition, when a golfer travels to a practice range or golf simulator, they often only bring a few clubs and accessories to use.

Noting the need for a simple device to carry a minimum number of golf clubs and accessories, prior art devices for this purpose have been developed and range widely in their versatility and function. Most prior art carriers utilize one or more tubes, which accept the shaft of the club, to carry several clubs. These tubes are generally aligned parallel to one another in order to separate the clubs and are relatively long to prevent the clubs from slipping out of the carrier. The length and width of these tubes increase the size and weight of the carrier and many such carriers approach the bulkiness of a golf bag. Moreover, the length of the tubes does not prevent the clubs from falling from the carrier when the device is inverted or tilted at a severe angle. Additionally, these carriers do not hold the clubs snugly in place allowing them to rotate around while transporting the carrier. This allows the club heads to hit each other causing damage. In addition, these parts are generally made of multiple components making them relatively expensive to manufacture and assemble, therefore they approach the cost of a conventional golf bag.

Other prior art devices utilize a series of clips that fit around the club shaft to retain the clubs. Generally, these clips are secured to a metal or plastic frame for support. However, in the devices of this type known to applicant, the grips of the clubs are prevented from contacting the ground and turf by driving one or more spikes into the turf to support the carrier. Repeatedly placing and removing the spiked carrier causes wear on the turf, which is undesirable at a golf course. Also such carriers depend upon good penetration of the spikes into the ground and if the ground is hard, this may be difficult to achieve. In addition, these carriers are made of multiple components making them relatively expensive to manufacture and assemble, therefore they approach the cost of a conventional golf bag.

Small golf bags have been manufactured that only hold a few clubs and accessories. The difficulty with such bags is that they do not firmly hold the clubs and therefore the clubs bang each other during transportation and can be damaged. In addition, these bags generally only contain one pocket for accessories. The user can not easily identify and retrieve the desired accessory because they are all mixed together. For example, if the user desires to quickly retrieve a small ball marker or a certain size tee to fit the conditions of the ground he must unzip the pocket and search through an array of balls, tees, ball markers, and pencils to find the one he needs. These bags are also expensive, bulky and difficult to load into an automobile making them impractical for the typical user.

There are also carriers with a rack type structure that allows the user to carry clubs and accessories. However, these carriers are generally made up of a number of individual components that must be assembled together. This greatly increases the cost of the units making them relatively expensive for the common golfer. In addition, generally these carriers are not designed to hold clubs, balls, tees, a ball marker and a pencil together in a compact package. The one-piece carriers of this type require expensive molds that incorporate slides and carns.

Therefore, a compact, lightweight, one-piece, partial golf club set and accessory carrier that can be easily and inexpensively molded is desired. The present carriers that will accommodate a partial set of golf clubs and accessories do not contain all of these qualities.

OBJECTS AND ADVANTAGES

Accordingly, several objects and advantages of the present invention are:

1. to provide a golf club and accessory carrier that will allow clubs, balls, tees, a ball marker and pencil to be easily attached and detached;
2. to provide a carrier that is compact and convenient to carry;
3. to provide a carrier that is inexpensive to manufacture by making it from a single injection molded piece to offer the player an inexpensive alternative to a golf bag or expensive carrier;
4. to provide a carrier that will carry golf clubs, balls, tees, a ball marker and pencil that can be easily molded using a relatively inexpensive molding die that does not require any cams or slides to create the part;

Further objects and advantages are to provide a golf club and accessory carrier which is simple to use and convenient to transport. Another object and advantage is that this invention can also be made in a variety of sizes and colors.

Further objects and advantages of the present invention will become apparent from a consideration of the drawings and ensuing description.

DRAWING FIGURES

REFERENCE NUMERALS IN DRAWINGS

| | | | |
|---|---|---|---|
| 10 | carrier | 12 | handle |
| 14 | hole | 16a | end wall |

-continued

| | | | |
|---|---|---|---|
| 16b | end wall | l8a | clip |
| l8b | clip | 20 | bump |
| 22 | scallop | 24a | front recess |
| 24b | front recess | 26a | rear recess |
| 26b | rear recess | 28 | tee mount |
| 30 | marker mount | 32 | pencil mount |
| 34 | horizontal wall | 36a | front nib |
| 36b | rear nib | 38 | support flange |
| 40 | vertical support wall | 42a | club |
| 42b | club | 44 | tee |
| 46 | pencil | 48 | ball marker |
| 50 | ball | | |

SUMMARY

In accordance with the present invention, a golf club and accessory carrying device, comprising a single piece plastic molded body. The body consists of a handle for carrying, a support structure, and a plurality of different flexible clips and holders to allow the attachment of golf clubs, tees, balls, a ball marker and pencil.

DESCRIPTION OF INVENTION

Figure 1:
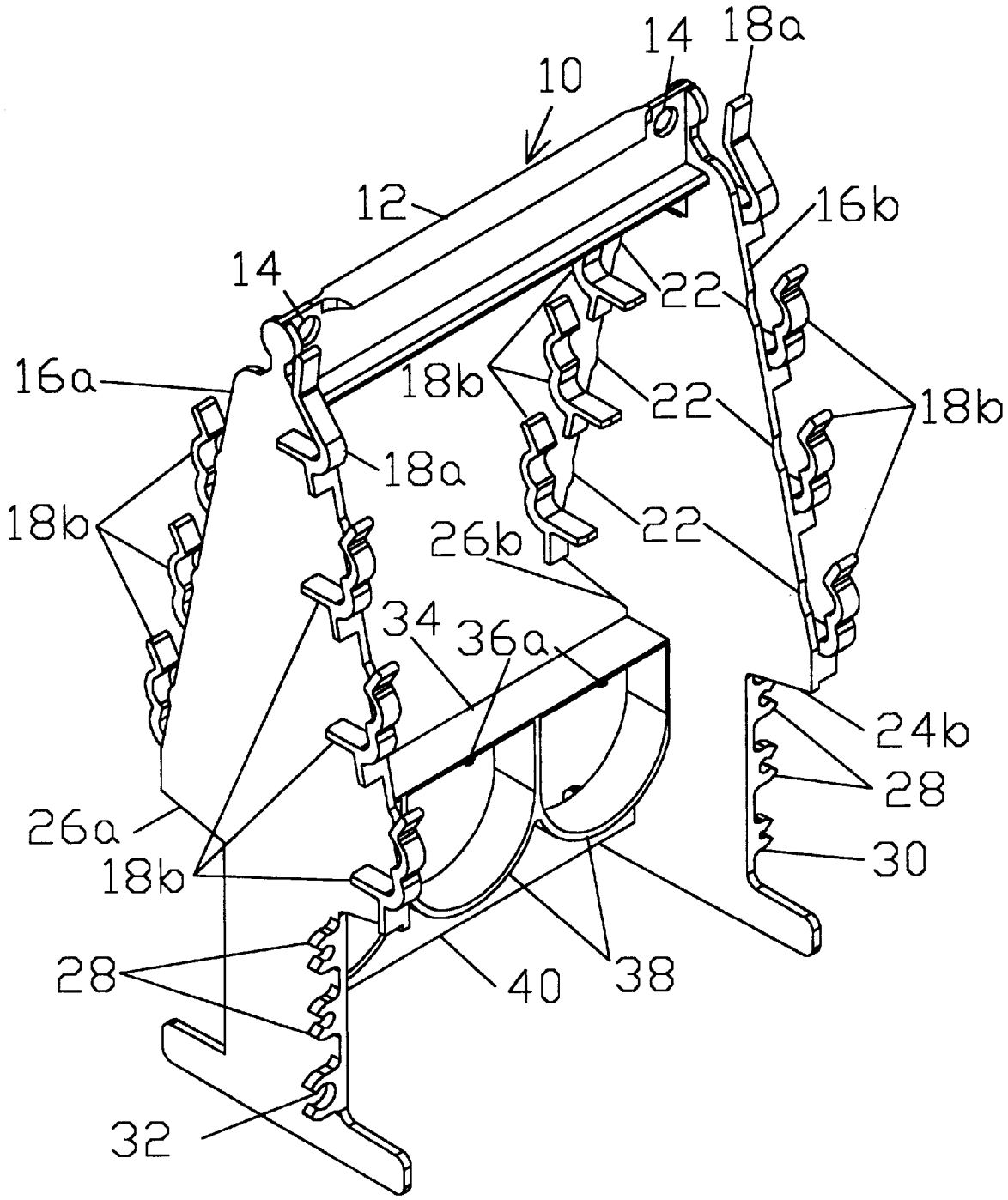
FIG. 1 is a front perspective view of the present invention.

FIG. 1 shows a front perspective view of a basic version of the present invention, a golf club and accessory carrier 10. The carrier as a whole is formed as a one-piece element preferably composed of a plastic material. Carrier 10 comprises a handle 12 that extends between two planar end walls 16*a* and 16*b*. Handle 12 has an I-beam shape. The top of the handle has a flared out section that extends for most of its length. The bottom portion of handle 12 also has a flared out section that extends for the entire length of the handle ending at the inside surface of end walls 16*a* and 16*b*. A thin vertical wall connects the top and bottom flared portions of the handle as shown in the figure. This thin vertical wall also connects to the inside surface of the end walls. Two through holes 14 are located in the thin vertical section near the upper left and upper right corners of this vertical wall.

Figure 2:
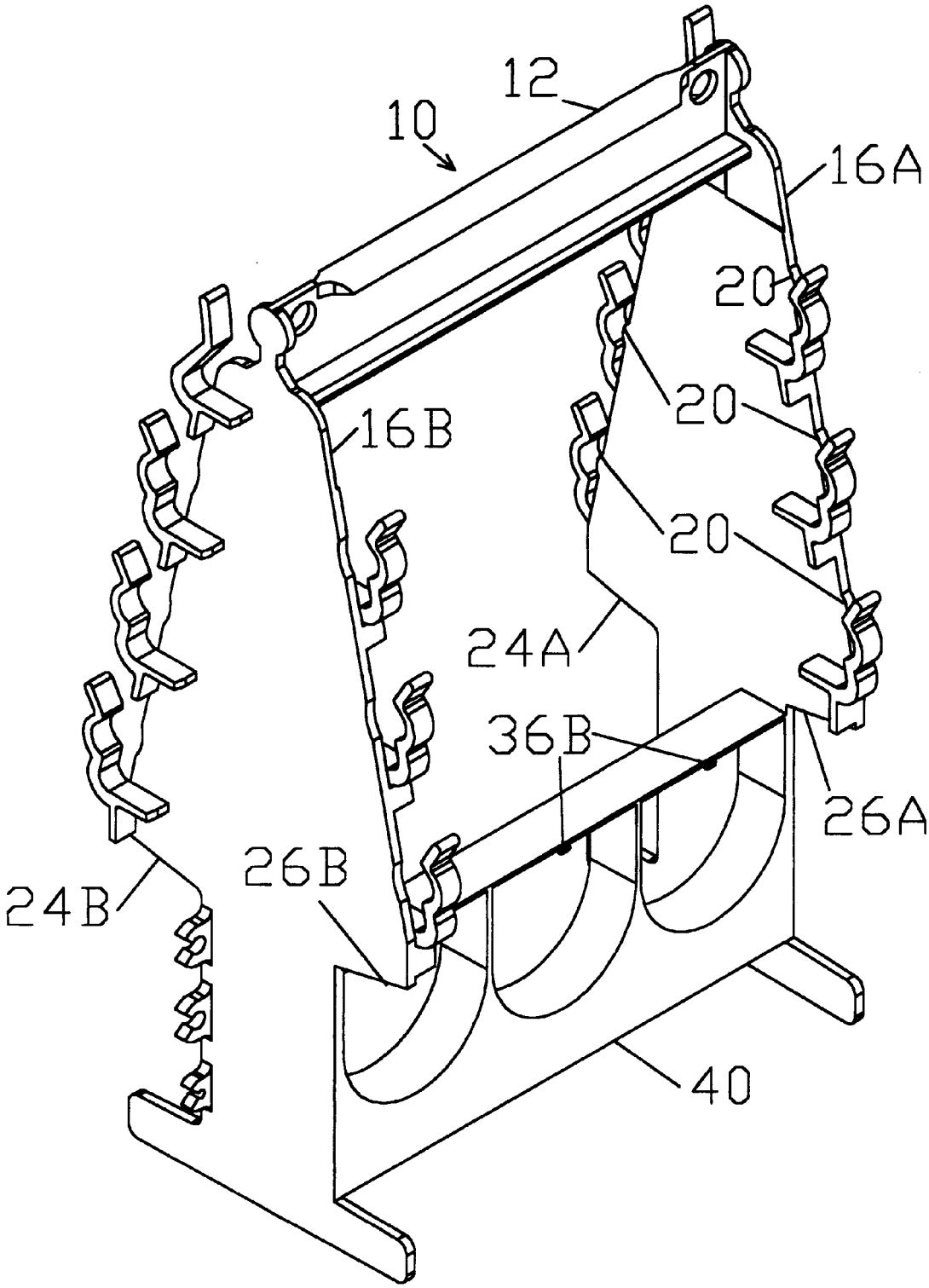
FIG. 2 is a rear perspective view of the present invention.

Planar end walls 16*a* and 16*b* have top and bottom portions and inner and outer surfaces and extend downwardly from the ends of handle 12 at a constant thickness. The end walls are shaped generally as Christmas trees. The tops of the end walls arc level with the top of the handle and configured with a round top portion supported by a thin neck section that flares out to a wider wall near the bottom of the handle. The end walls extend downward on an angle from the bottom of the handle such that they continue to increase in width for slightly more than half of their length. Then the end walls continue straight down at a constant width. Front recesses 24*a* and 24*b* and rear recesses 26*a* and 26*b* form cutouts in end walls 16*a* and 16*b* as shown in FIGS. 1 and 2. The bottom portion of the end walls is sufficiently wide for resting upon a ground surface when the carrier is deployed thereon.

Extending from the outside edge of end wall 16*a* are six bumps 20, three on the front outside edge and three on the back outside edge. The bumps have an approximate radius of five millimeters and protrude beyond the planar portions of the outside edge approximately one millimeter. The bumps are positioned such that they are approximately one millimeter above the center of the large radius on each clip 18*b*.

Cut into the outside edge of end wall 16*b* are six scallops 22, three on the front outside edge and three on the back outside edge as shown in FIG. 2. The scallops have a radius of approximately five millimeters and a depth below the planar portion of the front and back outside edges of end wall 16*b* approximately one millimeter. The scallops are positioned such that they are approximately one millimeter above the center of the large radius on each clip 18*b*.

Extending from the outer surfaces of end walls 16*a* and 16*b* are two identical clips 18*a* that have a width extending perpendicularly away from the outer surface of the end wall in which the clip is attached. This attachment configuration of clips 18*a* to the outer surface of the end walls greatly reduces the plastic mold tooling cost and complexity since the mold can be made without the need for any cams or slides. Each clip 18*a* is formed using a thin wall flexible geometry in which the wall thickness at the base of the clip that connects to the outside surface of the end wall is approximately four millimeters thick. The wall of clip 18*a* tapers thinner to around two millimeters thick approximately three quarters of the way up the clip. As shown in FIG. 1 the thin wall forming clip 18*a* extends parallel to the outer surface of the end wall in which it is connected and extends in a direction away from the center of the carrier. The thin wall forming the clip continues to extend beyond the outside edge of the wall approximately 10 millimeters and then turns upward along a large radius and extends along a straight portion at an angle inclined toward handle 12. The large radius of clip 18*a* is sized to be slightly smaller than the radius of the shaft of golf club 42*a*. At the upper end of this straight inclined wall is a small radius that turns the thin wall at an angle inclined away from the handle forming a wide receiving opening for the shaft of club 42*a* between the inside surface of clip 18*a* and the outside edge of the end walls as shown in FIGS. 1 and 2.

Additionally, as shown in FIGS. 1 and 2, extending from the outer and inner surfaces of end walls 16*a* and 16*b* are twelve identical clips 18*b* that have a width extending perpendicularly away from the planar surface of the end wall in which clips 18*b* are attached. This attachment configuration of clips 18*b* to the outer surface of the end walls greatly reduces the plastic mold tooling cost and complexity since the mold can be made without the need for any cams or slides. Each clip 18*b* is formed using a thin wall flexible geometry in which the wall thickness at the base of the clip connected to the end wall is approximately four millimeters thick. The wall of clip 18*b* tapers thinner to approximately two millimeters thick approximately three quarters of the way up the clip. As shown in FIG. 1 the thin wall forming clip 18*b* extends parallel to the planar surface of the end wall in which it is connected and extends away from the center of the carrier. The thin wall forming the clip continues to extend beyond the outside edge of the end wall for approximately 10 millimeters and then turns upward along a large radius that is sized slightly smaller than the radius of the shaft of golf club 42*b*. Next the wall extends along a straight portion at an angle inclined toward the outside edge of the end wall. The thin wall forming clip 18*b* next turns outward along a large radius. The upper end of this large radius terminates in a small radius that turns the wall at an angle inclined away from the edge of the end wall forming a wide receiving opening for the shaft of club 42*b* between the inside surface of clip 18*b* and the outside edge of the end wall as shown in FIGS. 1 and 2.

Four tee mounts 28 extend perpendicularly outward from the outer surfaces of end walls 16*a* and 16*b* as shown in FIG. 1. Each tee mount is C-shaped having flexible walls forming a split through bore within them. The split bore of the tee mount has an inside diameter that is slightly smaller than the diameter of a typical golf tee. Each tee mount starts at the bottom of either front recess 24*a* or 24*b* and extends rearward approximately three millimeters.

A pencil mount 32 extends perpendicularly outward from the outer surface of end wall 16*a*. Pencil mount 32 is C-shaped having flexible walls forming a split through bore within it. The split bore of the pencil mount has an inside diameter that is slightly smaller than the diameter of a typical score keeping pencil. The pencil mount starts at the bottom surface of front recess 24*a* and extends rearward approximately three millimeters.

A marker mount 30 extends perpendicularly outward from the outer surface of end wall 16*b*. Marker mount 30 is C-shaped having flexible walls forming a split through bore within it. The split bore of the marker mount has an inside diameter that is slightly smaller than the diameter of the shaft on a typical ball marker. The marker mount starts at the bottom surface of front recess 24*b* and extends rearward approximately three millimeters.

Referring now to FIGS. 1 and 2, a thin planar flexible horizontal wall 34 is formed from the inside surfaces of end walls 16*a* and 16*b* and extends between the walls. The wall is approximately one millimeter thick and extends fourteen millimeters rearward. Three protruding front nibs 36*a* and three protruding rear nibs 36*b* extend off of the bottom surface of the horizontal wall. Both the front and rear nibs are located near the front and rear outer edges of horizontal wall 34. Each pair of the front and rear nibs are spaced along the length of the horizontal wall extending between the end walls at a distance of slightly more than the diameter of a golf ball as shown in FIGS. 1 and 2. Front nibs 36*a* and rear nibs 36*b* are formed from the bottom surface of the horizontal wall and extend downward from the wall a distance of one millimeter. Both the front and rear nibs are spherical shaped with a radius of approximately one millimeter. Three U-shaped thin wall ball support flanges 38 are formed from the underside of horizontal wall 34 and extend downward. Each support flange 38 has a wall thickness of approximately one millimeter and a width beginning at the bottom of rear recesses 26*a* and 26*b* and extending forward approximately fourteen millimeters. A thin planar vertical support wall 40 is formed from the underside of support flanges 38 and extends downward, ending at the bottom of rear recesses 26*a* and 26*b*. The face of the vertical support wall begins at the bottom of rear recesses 26*a* and 26*b* and extends forward for approximately one millimeter.

Figure 3:
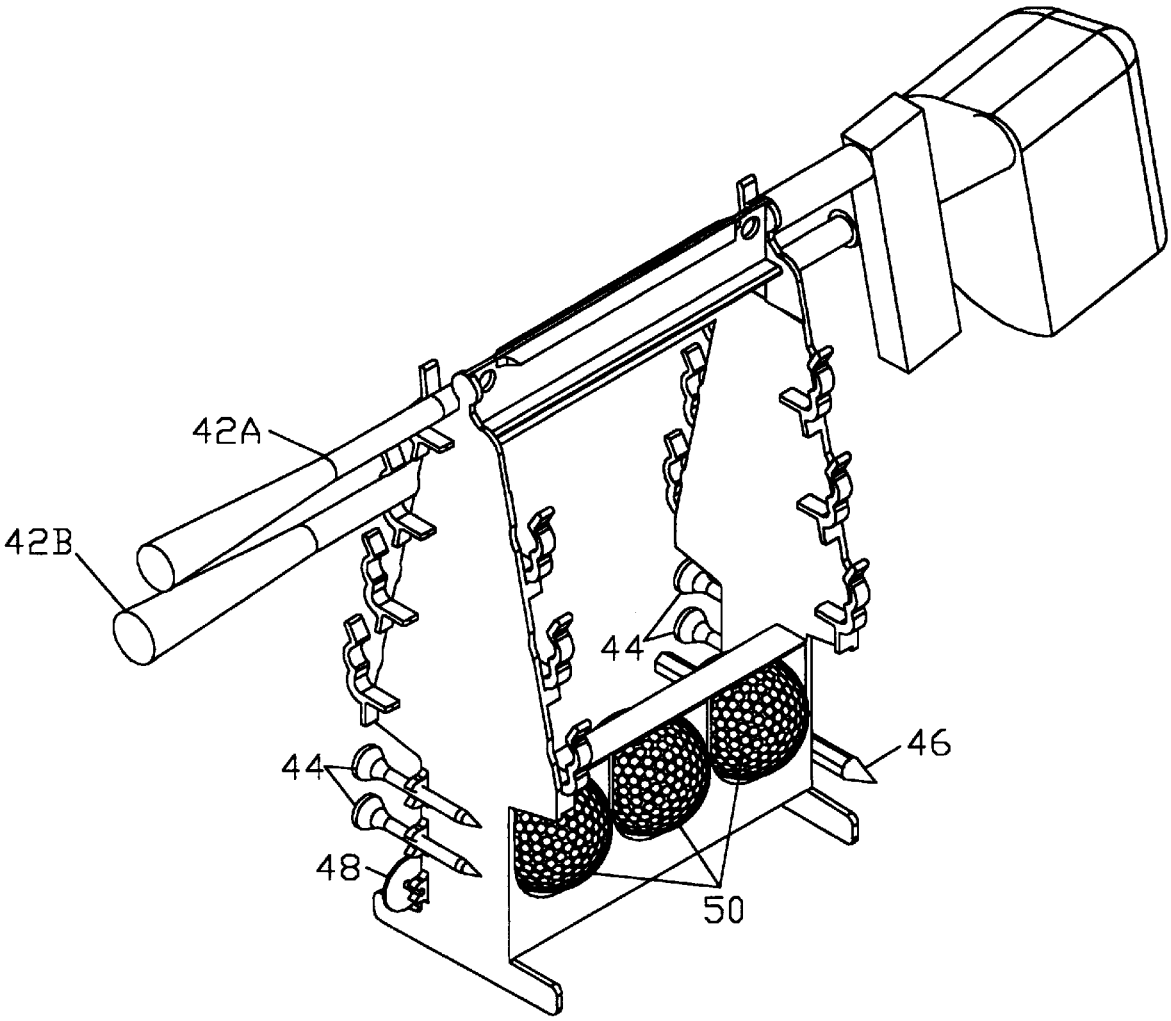
FIG. 3 is a rear perspective view of the present invention with golf clubs, balls, tees, a ball marker and a pencil attached to the carrier.

In FIG. 3, the carrier is shown with all of the accessories attached. A golf club 42*a* is shown snapped into clips 18*a*. The shaft of club 42*a* is engaged between the inside surfaces of clips 18*a* and the outside edges of end walls 16*a* and 16*b*. A golf club 42*b* is also shown snapped into a top pair of clips 18*b*. The shaft of club 42*b* is engaged between the inside surfaces of clips 18*b* and the outside edges of end walls 16*a* and 16*b*. Four tees 44 are held in place by tee mounts 28 on the outer surfaces of the end walls. A pencil 46 is held in position by pencil mount 32 on the outer surface of end wall 16*a*. A ball marker 48 is held in position by marker mount 30 on the outer surface of end wall 16*b*. Three golf balls 50 are shown retained in position by horizontal wall 34, front nibs 36*a* and rear nibs 36*b*, and support flanges 38.

OPERATION—FIGS. 1,2,3

The manner in which the present invention, a golf club and accessory carrier 10, is used and the function of the individual components of the carrier will now be described. The top portions of end walls 16*a* and 16*b* are concave shaped to accept the shaft of golf club 42*a*. The shaft of club 42*a* is held between the concave shaped outside edges of the end walls and the inside surfaces of clips 18*a* as shown in FIG. 3. The round top edges of end walls 16*a* and 16*b* provide a lead-in area in which the shaft of club 42*a* can be guided into position between the inside surfaces of the clips and the outside edges of the end walls. As the end walls extend downward, they increase in width so that the user can more easily access each clip 18*b* since the clips follow the outside edge of the end wall in which they are attached. Therefore, the clips are horizontally offset from each other making them easier to access from the top. The bottom portions of the end walls are sufficiently wide for resting upon a ground surface when the carrier is deployed thereon.

Golf clubs 42*a* and 42*b* are installed on the carrier by first setting the carrier on a support surface standing up in the orientation shown in FIG. 2. The user grips handle 12 using one hand. This supports the top of the carrier and prevents it from tipping over. The other hand picks up club 42*a* by gripping the middle section of the shaft. The club is held above the carrier such that the hand that is gripping the club is approximately centered between clips 18*a*. The club is moved down until it makes contact between its shaft and the inside surfaces of snaps 18*a* and the outside edges of end walls 16*a* and 16*b*. The user applies downward force to the shaft of club 42*a* until clips 18*a* flex outward and allow the center of the shaft to pass beyond the narrowest opening between the inside of clips 18*a* and the outside edges of the end walls. Once the club shaft goes beyond this point, it snaps into the position shown in FIG. 3 and clips 18*a* spring back toward their original position but are still slightly flexed outward due to the shaft diameter preventing the clips from completely returning. In this way, clips 18*a* apply a clamp force onto the outside of the shaft of the club holding it securely in position on the carrier.

Club 42*b* is installed on carrier 10 by using one hand to grip handle 12 and the other to pick up club 42*b* by gripping the middle section of its shaft. The club is held above the carrier such that the hand gripping the club is approximately centered over two clips 18*b* that are located on opposing end walls at the same height. Club 42*b* is moved down until its shaft makes contact with the inside surfaces of snaps 18*b* and the outside edges of bump 20 and end wall 16*b*. The user applies downward force to the shaft of club 42*b* until clips 18*b* flex outward and allow the center of the shaft to pass beyond the narrowest opening between the inside of clips 18*b* and the outside edges of bump 20 and end wall 16*b*. Once the club shaft goes beyond this point, it snaps into the position shown in FIG. 3 and clips 18*b* spring back toward their original position but are still slightly flexed outward due to the shaft diameter preventing the clips from completely returning. In this way, clips 18*b* apply a clamp force onto the outside of the shaft of club 42*b* holding it securely in position. The procedure is repeated for each club 42*b* that is installed on carrier 10.

The front and back edges of end wall 16*a* have bumps 20 that are spaced at the same height as clips 18*b* on this end wall. In addition, the front and back edges of end wall 16*b* have scallops 22 that are spaced at the same height as clips 18*b* on this end wall as shown in FIGS. 1 and 2. These features are designed to accommodate the tapered shaft of club 42*b*. Club 42*b* must be positioned so that the taper on the club shaft is going in the direction that corresponds to the bumps and the scallops on the edges of the each end wall. That is, the larger diameter portion of the club shaft is aligned with end wall 16*b* that contains scallops 22. The smaller diameter portion of the shaft is aligned with end wall 16*a* that contains bumps 20. The bumps reduce the opening space between the edges of end wall 16*a* and the inside surfaces of clips 18*b*. Scallops 22 increase the space between the edges of end wall 16*b* and the inside surfaces of clips 18*b*. The space between the scallops and the inside surface of clips 18*b* is greater than the space between the bumps and inside surface of clips 18*b*. When club 42*b* is snapped in place between the inside surface of clip 18*b* on end wall 16*a* and the outside edge of the bump, clip 18*b* flexes outward and applies a clamp load on the shaft of the club. Similarly, the scallops are sized to cause clips 18*b* on end wall 16*b* to flex outward approximately the same distance, due to the larger shaft diameter, when club 42*b* is snapped into position as in the case of clips 18*b* on end wall 16*a* that have bumps 20 to accommodate the smaller diameter shaft. Therefore, clips 18*b* on both end walls apply approximately equal clamp force on the club shaft even though the shaft diameter is larger in the position of end wall 16*b* and tapers down to a smaller diameter at end wall 16*a*.

While still holding onto handle 12 with one hand, one can use the other hand to pick up golf tee 44. The point end of tee 44 is held in the direction toward the front of carrier 10 and is aligned with the center of the bore of tee mount 28. The tee is moved rearward toward the tee mount until the outside of tee 44 comes in contact with the inside bore diameter of tee mount 28. Tee 44 is pushed into the bore of the tee mount forcing the walls of the tee mount to flex outward expanding its bore enough to accept the shaft of the tee. Tee 44 is snugly fit into tee mount 28 as shown in FIG. 3. The walls of tee mount 28 apply a clamp force on the outside of tee 44 keeping it in the position shown in FIG. 3. The same procedure is repeated to install the rest of tees 44 into the tee mounts.

Using the same method as described for installing tees 44, pencil 46 is press fit into pencil mount 32 and ball marker 48 is press fit into marker mount 30. Again, on both the pencil mount and marker mount, the walls of the mounts flex outward while the pencil or the ball marker is pushed into their respective positions shown in FIG. 3. As in the case with tee mount 28, the walls of both the pencil mount and the marker mount apply a clamp force on the pencil or ball marker they are holding to keep them securely in position.

Front recesses 24*a* and 24*b* form cutouts in the front edge of end walls 16*a* and 16*b* to enable the tee mounts, pencil mount and ball marker mount to be recessed into the carrier. This ensures that the tees, pencil and ball marker will not extend beyond the front edge of the end walls. Therefore, these components cannot contact the leg of the user while the carrier is being transported. Rear recesses 26*a* and 26*b* form cutouts in the back of the end walls to make the carrier look more balanced.

While the carrier is resting on a support surface in the orientation shown in FIG. 1 and the user's hand has the handle gripped, three golf balls 50 can be installed. One at a time, each ball 50 is held in one hand in front of the U-shaped opening created by support flange 38 and horizontal wall 34. Ball 50 is then moved backward until the diameter of the ball contacts the inside surface of support flange 38 and front nib 36*a*. The ball is then forced into the position shown in FIG. 3 by pushing it into the opening created between the inside surface of the U-shaped support flange and the bottom surface of the horizontal wall. Front nib 36*a* stays in contact with the diameter of ball 50 and forces horizontal wall 34 to flex upward to allow ball 50 to slide past the front nib. Vertical support wall 40 serves to prevent support flange 38 from flexing downward or bowing sideways while the ball is forced into position. Once the middle of the ball moves beyond the front nib)the horizontal wall partially springs back to its original position. Ball 50 is moved backward until it contacts rear nib 36*b*. This position, shown in FIG. 3, traps ball 50 between front nib 36*a*, rear nib 36*b*, the bottom surface of the horizontal wall and the inside surface of the support flange. It should be noted that the ball could also be installed from the back of the carrier in which case the procedure would be the same, only the ball would contact rear nib 36*b* first and would be horizontally moved forward until it contacted front nib 36*a*. The procedure is repeated for each of the balls that are installed in the carrier.

The method in which the carrier is transported is simple and straightforward. Using one hand to grip handle 12, the user can pick up the carrier and allow it to hang at their side similar to the way a brief case is carried. To provide assistance in holding the carrier, holes 14 in the handle can be used for attaching a carrying strap. This allows the user to transport the carrier and all of the components attached to it using a shoulder strap. This is convenient for carrying a large number of clubs for a long distance such as in an 18-hole golf game.

As shown in FIGS. 1 and 2, end walls 16*a* and 16*b* extend downward from the side of handle 12 and provide a support structure in which clips 18*a* and 18*b*, tee mounts 28, pencil mount 32, marker mount 30, and the ball retainer extend.

SUMMARY, RAMIFICATIONS, AND SCOPE

Accordingly, the reader will see that the golf club and accessory carrier device of this invention can be used for golf activities easily and conveniently, can be transported just as easily using one hand, and can transport and store golf clubs, balls, tees, a score keeping pencil and a ball marker. Furthermore, this invention has the additional advantages in that (a) it provides a carrier that is inexpensive to manufacture by making it from a single injection molded piece to offer the player a low cost alternative to a golf bag;

(b) it provides a carrier that will carry up to seven golf clubs, three balls, four tees, a ball marker and a pencil that can be easily manufactured using a relatively inexpensive molding die that does not require any cams or slides due to the configuration of the retention clips;

(c) it permits a partial set of golf clubs, three balls, four tees, a ball marker and a pencil to be carried in a compact package size that is not bulky;

(d) it permits golf clubs, balls, tees, a ball marker and a pencil to be quickly located and easily attached and detached from the carrier;

(f) it provides a golf club carrier in which the clubs are firmly held in position and are not allowed to rotate or swing relative to each other or bang together causing club head and shaft damage;

Although the description above contains many specificities, these should not be construed as limiting the scope of the invention but as merely providing illustrations of some of the presently preferred embodiments of this invention. For example the handle could be other shapes such as round, oval, square, pistol gripped, or flat; the side walls could be made to have a constant width, a varying thickness, a box or round shape; the retention clips could be shaped differently; more clips could be added, some could be eliminated; the carrier could have more or less tee, pencil and ball marker holders; these holders could be completely enclosed holes rather than the C-shaped bores described; the front and rear recesses could be eliminated in the end walls; the carrier could add or delete some or all of the ball holders, etc.

Thus the scope of the invention should be determined by the appended claims and their legal equivalents, rather than by the examples given.

What is claimed is:

1. A golf club and accessory carrier comprising:

a one-piece plastic body having a pair of downwardly extending planar end walls, said end walls each having a top and bottom portion and an inner and outer surface, said bottom portion of said end walls being sufficiently wide for resting upon a ground surface when said carrier is deployed thereon; and a handle extending from said plastic body; and a plurality of retention clips spaced along at least one edge of said end walls extending from a face of said end walls for detachably receiving and securing the shaft of a golf club to said carrier.

2. The device of claim 1 further comprising retaining means to releasably attach a golf ball to said carrier.

3. The device of claim 2 wherein the retaining means to releasably attach said golf ball is a ball retainer that extends between said two end walls.

4. The device of claiiw 3 wherein the ball retainer comprises:

a support flange, said support flange is substantially U-shaped; and a thin planar wall extending between said inner surfaces of said end walls, said thin planar wall having a top and bottom surface, said support flange extends from said bottom surface of said thin planar wall; and a pair of small bumps extending downward from the edges of said bottom surface of said thin planar wall.

5. The device of claim 1 further comprising retaining means to releasably attach a golf tee to said carrier.

6. The device of claim 1 further comprising retaining means to releasably attach a golf ball marker to said carrier.

7. The device of claim 1 further comprising retaining means to releasably attach a pencil to said carrier.

8. The device of claim 1 wherein the handle contains two through holes for connecting a shoulder strap.

9. The device of claim 1 wherein one of the planar end walls has bumps extending outward from the outer edge of said end wall at the same height as said retention clips.

10. The device of claim 1 wherein one of the planar end walls has scallops cut into the outer edge of said end wall at the same height as said retention clips.

11. A golf club and accessory carrier comprising:

a one-piece plastic body having a pair of downwardly extending planar end walls, said end walls each having a top and bottom portion and an inner and outer surface, said bottom portion of said end walls being sufficiently wide for resting upon a ground surface when said carrier is deployed thereon; and a handle extending between said two end walls at the upper ends thereof; and a plurality of retention clips spaced along at least one edge of said end walls extending from a face of said end walls for detachably receiving and securing the shaft of a golf club to said carrier.

12. The device of claim 11 further comprising retaining means to releasably attach a golf ball to said carrier.

13. The device of claim 12 wherein the retaining means to releasably attach said golf ball comprises:

a support flange, said support flange is substantially U-shaped; and a thin planar wall extending between said inner surfaces of said end walls, said thin planar wall having a top and bottom surface, said support flange extends from said bottom surface of said thin planar wall; and a pair of small bumps extending downward from the edges of said bottom surface of said thin planar wall.

14. The device of claim 11 further comprising retaining means to releasably attach a golf ball marker to said carrier.

15. The device of claim 11 further comprising retaining means to releasably attach a pencil to said carrier.

16. A golf club and accessory carrier comprising:

a plastic body having a pair of downwardly extending planar end walls, said end walls each having a top and bottom portion and an inner and outer surface; and a handle extending from said plastic body; and a plurality of retention clips spaced along the front and back edges of said walls extending from said inner and said outer surfaces of said end walls for detachably receiving and securing the shaft of a golf club to said carrier.

17. The device of claim 16 further comprising retaining means to releasably attach a golf ball.

18. The device of claim 16 further comprising retaining means to releasably attach a golf ball marker.

19. The device of claim 16 further comprising retaining means to releasably attach a pencil.

20. The device of claim 19 further comprising a retaining means to releasably attach a golf ball; and a retaining means to releasably attach a golf ball marker; and a retaining means to releasably attach a golf tee.

* * * * *